US006101955A

United States Patent [19]

Salce

[11] Patent Number: 6,101,955

[45] Date of Patent: Aug. 15, 2000

[54] PALLET COVER

[76] Inventor: Gary J. Salce, 226 Alberta St., Fairfield, Conn. 06432

[21] Appl. No.: 09/204,150

[22] Filed: Dec. 3, 1998

[51] Int. Cl.[7] ..... B65D 19/00

[52] U.S. Cl. ..... 108/51.11; 108/901; 248/346.02

[58] Field of Search ..... 108/51.11, 57.25, 108/57.29, 57.33, 901; 248/346.02

[56] References Cited

U.S. PATENT DOCUMENTS

| | | | |
|---|---|---|---|
| 4,189,125 | 2/1980 | Little | 248/346.02 |
| 4,393,999 | 7/1983 | Forshee | 108/901 X |
| 4,467,612 | 8/1984 | Weasel, Jr. | 108/901 X |
| 4,848,247 | 7/1989 | Kuipers | 108/901 X |
| 4,869,456 | 9/1989 | Jacobs | 108/901 X |
| 4,871,063 | 10/1989 | Kumbier . | |
| 5,052,307 | 10/1991 | Morison | 108/55.3 X |
| 5,415,109 | 5/1995 | McBride | 108/57.29 |
| 5,429,236 | 7/1995 | Evans . | |
| 5,562,047 | 10/1996 | Forney et al. . | |
| 5,664,394 | 9/1997 | Sweeney | 108/901 X |
| 5,749,555 | 5/1998 | Albrecht | 108/901 X |

FOREIGN PATENT DOCUMENTS

| | | | |
|---|---|---|---|
| 52-32140 | 8/1977 | Japan | 108/901 |

*Primary Examiner*—Janet M. Wilkens
*Attorney, Agent, or Firm*—James F. Cottone

[57] ABSTRACT

A plastic pallet cover is specially formed as a one-piece, high-strength device for ideally isolating a pallet load from the wood surface of a pallet. The pallet cover thereby protects the load from being contaminated by any bacteria, mold, or other disease-causing agents on the pallet, and provides a safe and sanitary surface for the storage and transport of food product loads such as shellfish or other edible products susceptible to contamination. The pallet cover is preferably made of plastic formed by the molding process to include a horizontal upper surface which fits over a conventional wooden pallet to isolate the pallet from the load, as well as a grid of internal ribs and edge walls to provide strength, rigidity, and positional stability. Additionally, the upper surface of the pallet cover includes raised extrusions to improve the friction grip on the pallet load, as well as drainage and weep holes to prevent contaminating fluids from collecting, stagnating and comingling on the surface of the isolating cover or on the underlying pallet.

15 Claims, 2 Drawing Sheets

PALLET COVER

TECHNICAL FIELD

The present invention relates generally to portable shipping platform covers, and in particular to a uniquely formed pallet cover which is particularly adapted for mounting on conventional wooden pallets to protect food products from contamination and to protect the upper surface of a wooden pallet from damage.

BACKGROUND

The wooden shipping pallet has been used for handling and transporting materials for many years and there are millions of such pallets in widespread use today. Wooden pallets are the platform on which virtually all of the world's goods have been stored, warehoused, transported, and distributed. As such, they are an integral and very important component of worldwide commerce.

One of the problems associated with wooden pallets, especially when they are used to carry food products, is poor sanitation. Pallets are generally stored outdoors, or in warehouses where they are exposed to the accumulation of dirt, debris, and the infiltration of a wide variety of parasites. Mold and bacteria also grow on wooden pallet surfaces. Constant cleaning and/or fumigation is required to maintain adequate health standards when food products are carried by the pallets. Wooden pallets are difficult to sanitize because of the inherent cracks, voids, and imperfections in the wood surface where dirt and micro-organisms readily accumulate. In particular, raw fish and meat are easily contaminated by simple contact with a pallet. Additionally, the porous surface of wood pallets makes them particularly difficult, if not impossible, to sanitize. Splinters and wood chips picked up by the food products being transported or stored also pose a significant health threat.

Attempts to address the problems of sanitation have led to a wide variety of wooden pallet substitutes. These include pallets made of plastic, steel, aluminum, fiber board, and combinations of these materials. One sanitary solution to the problem is the pallet totally fabricated from plastic. This totally plastic pallet surface is impervious to dirt and micro-organisms and is thus easily cleaned and sanitized. While the plastic pallet provides a sanitary surface, it is not, however, very cost effective, because plastic pallets can cost up to ten times as much as their wooden counterparts. Also, there are many millions of wooden pallets in use today. Conversion to use of all-plastic pallets would render the wooden pallets obsolete resulting in significant lost investment and countless tons of solid waste.

Description of typical prior art approaches to the problem of providing sanitary pallets may be found in a number of U.S. patents.

U.S. Pat. No. 3,273,518 to Shina, issued in 1966, discloses a thin, rectangular pallet, including four leg portions, made of corrugated paperboard that is coated with a thin transparent layer of polyethylene to render it substantially waterproof. Of interest is a showing of a series of openings or holes in the rectangular flat top sheet that permit air or liquids to pass through it.

U.S. Pat. No. 5,473,995 to Gottlieb discloses a pallet top also made of corrugated hardboard which is described as being more hygienic than the conventional wooden pallet top. The background section provides a good description of the problem being addressed, namely the unsanitary propensities of wooden pallets, especially in the food handling industries.

U.S. Pat. No. 5,778,801 to Delacour provides a more recent (1998) teaching of a pallet made of solid plastic materials such as polyethylene or polypropylene for hygienic reasons. The pallet structure, however, includes the conventional top platform and block type legs for conventionally being lifted by a forklift.

Additional prior art teachings of background interest are found in U.S. Design Pat. No. 364,030 to Pigott, et al., which discloses the ornamental design for what appears to be a completely plastic pallet including arrays of apertures, and U.S. Pat. No. 4,871,063 to Kumbier. Which discloses a multiple layer pallet cover for protecting the upper surfaces of a load resting on a pallet.

While each of these prior art approaches acknowledges the importance of a high degree of sanitation consciousness when transporting raw foodstuffs, they address the task with ever-increasing apparatus complexity, and basic cost effectiveness has been clearly sacrificed. It is this cost-effective need that the present invention admirably meets with its elegant and straightforward retrofittable plastic pallet cover approach.

OBJECTS OF THE INVENTION

It is therefore a primary object of the present invention to provide improved apparatus in the form of a pallet cover to provide a sanitary environment that provides protection from contamination of food products carried by the pallet.

A further object of the present invention is to provide a cost-effective means of converting existing wooden pallets into highly sanitary means for holding and carrying foodstuffs, particularly for moist food products susceptible to contamination by contact with foreign substances or pathogens.

A still further object of the present invention is to provide a self-retaining pallet cover implemented by capping the perimeter of a wooden pallet with overlapping edge rib structures.

A yet further object of the present invention is to protect the upper surface of wooden pallets from damage thereby extending their useful life.

In a preferred embodiment, a thin plastic pallet cover is formed as a shallow, inverted tray adapted to fit over a standard-sized wooden pallet to isolate the wood from the product being carried. An upper planar surface of the cover includes an array of raised elements to provide a nonslip surface, as well as an interdigitated array of drainage holes to prevent collection and stagnation of liquids seeping from the product. This is especially advantageous for the storage, handling, and shipping of shellfish. An array of supporting ribs formed into the lower surface of the cover, and edge ribs formed along the periphery of the cover provide, respectively, strengthening and rigidifying for the pallet cover, and self-contained means for securely retaining the pallet cover over the pallet itself. The one-piece plastic cover formed of impervious material can be easily cleaned, reused indefinitely, and greatly improves the sanitary capabilities of the existing stock of used wooden pallets.

BRIEF DESCRIPTION OF THE DRAWINGS

Additional objects and advantages of the invention will become apparent to those skilled in the art as the description proceeds with reference to the accompanying drawings wherein.

BEST MODE FOR CARRYING OUT THE INVENTION

Figure 1:
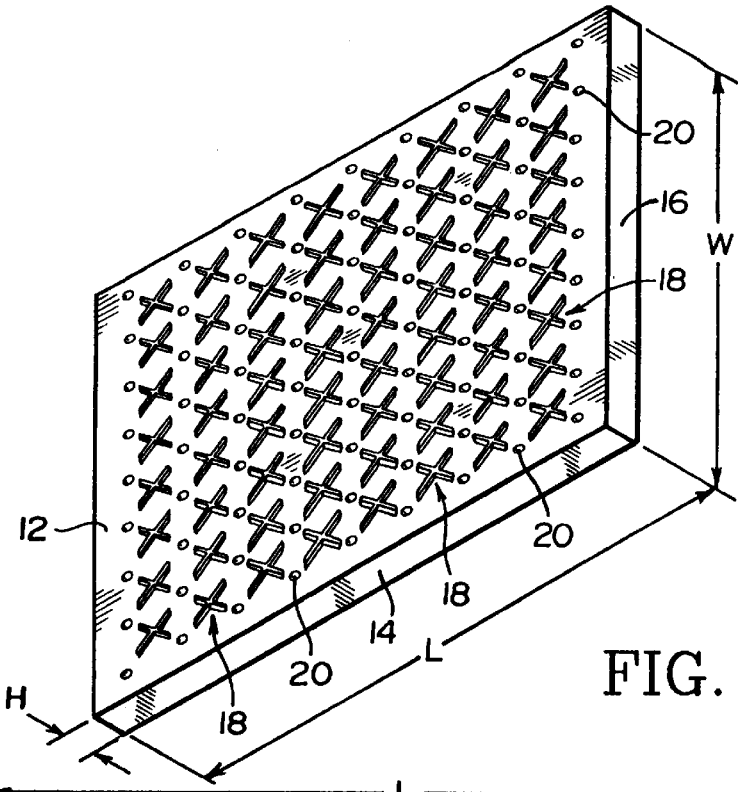
FIG. 1 is a perspective view of a pallet cover according to the present invention.

Referring now to FIG. 1, there is shown a perspective view of a pallet cover according to the present invention. By way of a brief overview, a pallet cover 10 is ideally formed as a one-piece unit in the general shape of a shallow, inverted, rectangular tray having a load-carrying top surface element 12, front and back edge ribs 14, and side edge ribs 16. The surface element 12 is substantially planar and further includes a plurality of raised extrusions 18 arrayed in a more or less uniform geometric pattern over its top surface. A plurality of drainage holes 20 are formed through the surface element 12, also arrayed geometrically distributed over the surface 12 and interspersed uniformly with the array of raised extrusions 18. In use, the pallet cover is placed over a suitably sized wooden pallet such that the edge ribs fit cap-like over the ends of the pallet to securely retain the cover in place. The drainage holes 20 serve to drain off any liquids initially dripping from the product being carried or which may later accumulate on the top surface 12. The raised extrusions 18 provide sufficient intermittently positioned rough elements on the surface 12 to prevent slipping or skidding of the load being carried on the pallet cover 10.

In a typical embodiment, the pallet cover 10 may have a length "L" of just over four feet, a width "W" of about three and a half feet, and an overall height "H" of just under two inches—thus giving the overall outer appearance of a shallow inverted tray. Typical materials contemplated for its fabrication include plastics of all types, thin metallic sheets, and similar smooth-surfaced and impervious materials.

Figure 5:
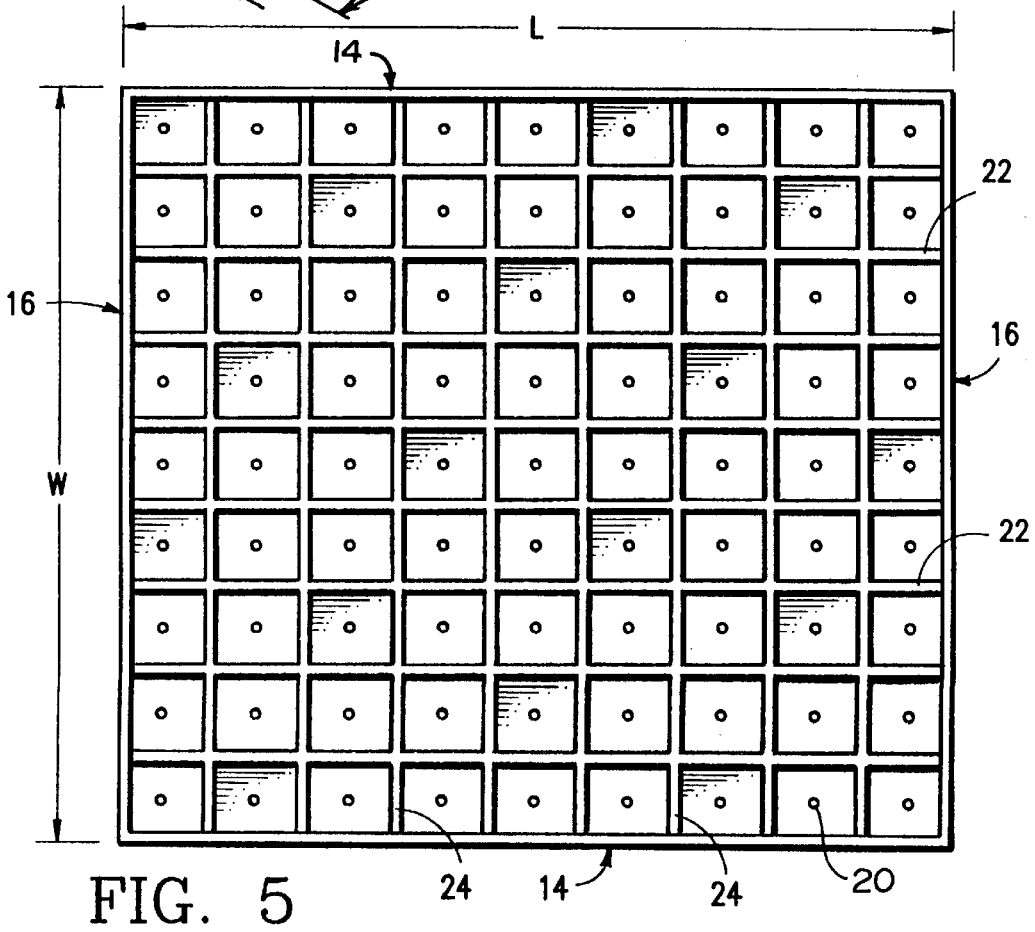
FIG. 5 is a bottom plan view of the pallet cover.
Figure 2:
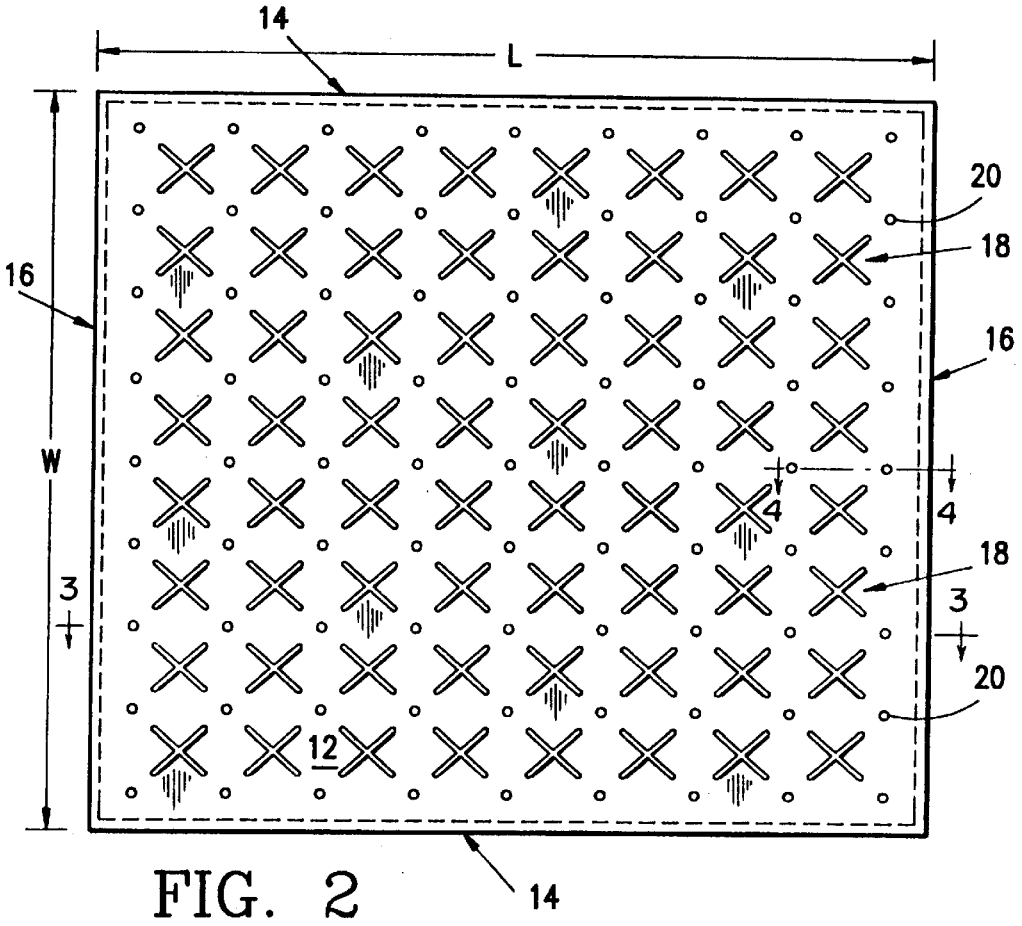
FIG. 2 is a top plan view of the pallet cover of FIG. 1.
Figure 3:
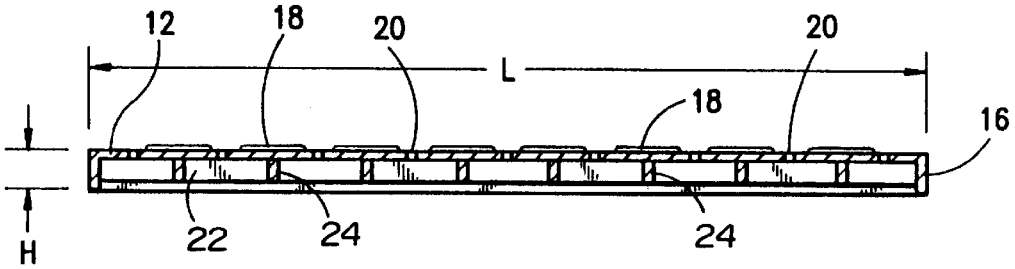
FIG. 3 is a partial cross-sectional view of the pallet cover taken along the lines 3—3 of FIG. 2.
Figure 4:
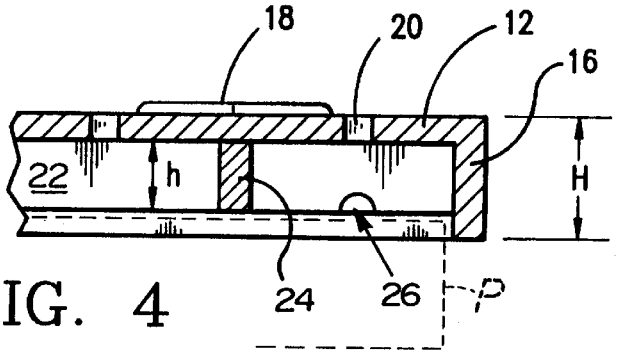
FIG. 4 is a partial cross-sectional view of the pallet cover taken along the lines 4—4 of FIG. 2.

Significant additional structural and functional features of the pallet cover 10 are described with reference now to a top plan view of FIG. 2, a cross-sectional view of FIG. 3, and a bottom plan view of FIG. 5. Greatly increased load-bearing strength and overall rigidity is imparted to the cover 10 by means of an array of support ribs integrally formed in a grid-like manner on the underside of the top surface element 12. These are best shown in FIG. 5. A plurality of longitudinal support ribs 22 (parallel to front and back edge ribs 14) and a plurality of transverse ribs 24 (parallel to side edge ribs 16) are orthogonally melded together to produce the desired grid. The ribs 22 and 24—as well as the ribs 14 and 16—may be just under one-half inch in thickness and when molded integrally into the lower surface of the surface element 12 produce the desired strengthening and rigidifying using a minimal amount of material. The strengthening derives from the effects of honeycombing and T-beam structure of the surface element 12 and ribs 22 and 24 combination. With momentary reference to the partial cross-sectional view of FIG. 4, the relative dimensions of the various elements are shown. The height "h" of ribs 22 and 24 is slightly less than the height "H" of the side edge ribs 16 (as well as edge ribs 14, not shown) allowing the edge ribs 14 and 16 to loosely overlap the ends of an underlying pallet P (shown in phantom) to ensure stable non-sliding retention of the cover. The support ribs 22 and 24 have a plurality of weep holes or slots 26 cut out of their bottom edges. These openings allow water to drain down through and across the wooden pallet, thereby preventing water accumulation and stagnation on the pallet surface. These weep holes further reduce the possibility for contamination and infestation by eliminating a breeding environment for pathogens.

The array of raised extrusions 18 are shown, illustratively, as an 8×8 array of stand-alone "X"-like elements, each slightly longer than it is wide and extending for a height of nominally one-eighth inch above the upper surface of surface element 12. Preferably, the raised extrusions are integrally formed as by molding into the upper surface of the pallet cover 10. Alternatively, the raised extrusions may be fabricated separately and securely affixed to the surface element 12 by conventional means including adhesives, fasteners, and the like. Other patterns, such as diamonds, squares, and circles may be readily substituted for the "X" elements shown, the key being the provisioning of an interrupted pattern of friction-producing structures.

While the ribs 22 and 24 are shown as uniformly spaced in orthogonal arrays, other geometrical patterns such as diamonds and octagonal shapes may be readily substituted, the key being the providing of an iterative honeycomb-like pattern to produce the desired strengthening/rigidifying. In preferred embodiments, the various ribs 14, 16, 22, and 24 are formed in a one-piece molding process integrally with the surface element 12. However, selected rib members may be separately formed and affixed to themselves and to the surface element 12 by well-known attaching processes. The numbers and locations of the several arrays—the extrusions, drainage holes, support ribs, and weep holes—shown as uniformly distributed and interdigitated—may, of course, be varied considerably.

The unique combination of structural features described above gives rise to a number of functional benefits heretofore not fully appreciated. The key benefits of excellent sanitation capabilities using highly cost-effective structures in the storage, handling, and shipping of shellfish in particular are notable. For example, oysters and clams are normally carried in mesh bags that seep water from the food product onto the pallet cover during storage and transport. If liquids are allowed to stand on the surface of the pallet or on the upper surface of the pallet cover, or to provide a liquid conduit between the various constituents, a bacteria-breeding environment would be encouraged. The simple and efficient pallet cover 10, according to the present invention, is readily placed over existing standard-sized wooden pallets to greatly improve the health standard of raw food transporting. Use of the pallet cover 10 effectively converts the full existing inventory of used wooden pallets worldwide into very sanitary vehicles. Also, the cost savings over a completely plastic pallet structure are significant and preclude the tendency to scrap or discard wooden pallets for these critical sanitation usages.

The strong and durable pallet cover described herein in the various preferred embodiments adds very little to the overall weight burden, thereby providing additional transportation cost savings. The shallow overlap of the edge ribs not only secures the cover to the pallet, but is sized to prevent any damaging contact with tow motor forks when the pallet is being moved or lifted. And, the pallet cover helps hold the wooden pallet top slats in place and protects their surfaces from damage due to loading and unloading of industrial articles, as well as foodstuffs.

Although the invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A pallet cover comprising:

(a) a rectangular top planar element having an upper surface and a lower surface, said upper surface including a fixed array of raised anti-skid elements distributed across it, said lower surface including a grid of shallow depth supporting ribs fixedly arrayed over its extent;

(b) four edge ribs depending from the periphery of said top element and fixed to the outer ends of said supporting ribs, said edge ribs having a depth greater than said supporting ribs so as to fit cappingly over an underlying wooden pallet such that said pallet cover is self-retaining; and (c) said top element further including an array of drainage holes formed through it, whereby products carried on said pallet cover are protected against contamination from fluid and physical contact with said underlying wooden pallet.

2. The pallet cover of claim 1 wherein said arrays of anti-skid elements, supporting ribs, and drainage holes are uniformly interspersed over said planar element so as to produce interdigitated overlapping patterns.

3. The pallet cover of claim 1 wherein at least said planar element is formed of an impervious material selected from the group including plastics, metals and synthetics.

4. The pallet cover of claim 3 wherein all elements and ribs are formed of plastics, polyethylene, polypropylene, or other impervious synthetic materials integrally molded together.

5. The pallet cover of claim 3 wherein said anti-skid elements and said edge ribs are affixed to said planar element by adhesive, welding or fastening means.

6. The pallet cover of claim 5 wherein said grid of supporting ribs are integrally molded with said lower surface.

7. The pallet cover of claim 1 wherein said supporting ribs have a plurality of weep holes or slots oriented transversely and distributed longitudinally over their lower edges, whereby air and liquids may pass freely via them between said cover and said underlying pallet.

8. The pallet cover of claim 1 wherein said grid of supporting ribs is an orthogonal grid.

9. The pallet cover of claim 8 wherein said raised anti-skid elements extend nominally one-eighth inch above said upper surface and said rectangular cover is approximately five feet in length and three and a half feet in width.

10. A sanitary pallet cover for protecting products loaded on an underlying pallet from contamination via liquid or physical contact with said underlying pallet by interposing an impervious barrier between the products and said underlying pallet and for physically protecting said underlying pallet from loaded products, comprising:

(a) a rectangular top planar element of impervious material having an array of raised anti-skid elements distributed along its upper surface, an array of drainage holes formed through said top element, and an orthogonal grid of shallow supporting ribs having a first depth arrayed along the lower surface of said top element;

(b) four edge ribs depending from the periphery of said top element for a second depth greater than said supporting grid first depth, and adapted to fit cappingly over said underlying pallet; and (c) whereby products carried on said top element are isolated from said underlying pallet thereby inhibiting their contamination through liquid or physical contact with said underlying pallet and further protecting the upper surface of said underlying pallet from the loaded products.

11. The pallet cover of claim 10 wherein said arrays of anti-skid elements, supporting ribs, and drainage holes are uniformly interspersed over said top element to produce interdigitated and overlapping geometric patterns.

12. The pallet cover of claim 10 wherein all elements and ribs are formed of plastics or other impervious synthetic materials integrally molded together.

13. The pallet cover of claim 10 wherein said anti-skid elements and said edge ribs are affixed to said top element by adhesive, welding, or fastening means.

14. The pallet cover of claim 10 wherein said raised anti-skid elements extend nominally one-eighth of an inch above said upper surface of said top element and said rectangular pallet cover is less than five feet in length and less than four feet in width.

15. A sanitary pallet cover for protecting products loaded on an underlying pallet from contamination via liquid or physical contact with said underlying pallet by interposing an impervious barrier between the products and said underlying pallet and for physically protecting said underlying pallet from loaded products, comprising:

(a) a rectangular top planar element of impervious material having an array of raised anti-skid elements distributed along its upper surface, and an orthogonal grid of shallow supporting ribs having a first depth arrayed along the lower surface of said top element;

(b) four edge ribs depending from the periphery of said top element for a second depth greater than said supporting grid first depth so as to fit cappingly over said underlying pallet such that said pallet cover is self-retaining; and (c) whereby products carried on said top element are isolated from said underlying pallet thereby inhibiting their contamination through liquid or physical contact with said underlying pallet and further protecting the upper surface of said underlying pallet from the loaded products.

* * * * *